US005317490A

United States Patent [19]

Miller

[11] Patent Number: 5,317,490

[45] Date of Patent: May 31, 1994

[54] ENCASED FLASHLIGHT

[75] Inventor: Joseph T. Miller, Mehlville, Mo.

[73] Assignee: Mocap Incorporated, St. Louis, Mo.

[21] Appl. No.: 997,014

[22] Filed: Dec. 28, 1992

[51] Int. Cl.[5] ..... F21L 7/00

[52] U.S. Cl. ..... 362/206; 362/189

[58] Field of Search ..... 362/206, 205, 204, 189, 362/200, 295, 267; 200/60

[56] References Cited

U.S. PATENT DOCUMENTS

| | | | |
|---|---|---|---|
| 2,070,316 | 2/1937 | Recker | 362/206 |
| 2,666,894 | 1/1954 | Babernitsh | 362/206 |
| 3,742,207 | 6/1973 | Strauss | 362/206 |
| 4,303,970 | 12/1981 | Robertson | 362/206 |
| 4,774,643 | 9/1988 | McGinnis et al. | 362/189 |
| 4,905,129 | 2/1990 | Sharrah | 362/206 |

*Primary Examiner*—James C. Yeung
*Attorney, Agent, or Firm*—Paul M. Denk

[57] ABSTRACT

A flashlight incorporating operative components that include resilient parts, made of compressable rubber or a polymer, is used for providing the opening or closing of the circuitry for the flashlight to energize or de-energize it, when manual pressure is applied to the back end or sealing cap for the device. The flashlight includes its casing member, with a light exposing end, having an aperture through which the bulb projects its illumination, and a back or battery insertion end, with a sealing means or end cap for closing the casing at this location. A light source, such as a bulb, a battery, a connector for joining the light source to the battery, a fixed contact member integral of the battery, a movable contact member for opening and closing its circuitry, and a resilient member arranged intermediately between the movable contact member and the battery, such that when manual pressure is applied, the resilient member collapses, providing for contact between the electrical components for the flashlight to achieve its illumination. The resilient member being an O-ring or a sleeve, and the connector cooperates with the sleeve to make permanent contact with the movable contact member during assembly of the flashlight.

14 Claims, 2 Drawing Sheets

ENCASED FLASHLIGHT

BACKGROUND OF THE INVENTION

The present invention relates to flashlights, and more particularly to a flashlight made of soft or resilient plastic that allows battery replacement, and which incorporates resilient means separating an integrally flared movable contact member from the battery, to sustain the flashlight off, under normal conditions, but that upon compressing, the collapse of the resilient means provides for energization of the flashlight bulb, and its illumination for usage.

Flashlights provide a portable source of light which is beneficial when other sources of light are inaccessible, or not available. Some flashlights are disposable in the sense that they last only as long as their batteries endure. Other flashlights are non-disposable, and their batteries need to be replaced as necessary. The disposable models generally cost less to manufacture than the permanent type, but the long-term cost to the consumer of continually replacing disposable flashlights after each battery dies is more expensive than usage of the non-disposable model.

Several attempts have been made to manufacture non-disposable flashlights at a cost comparable to the disposable type. Some manufacturers have altered the working parts of the flashlight to produce a more versatile, cost-effective product. One of the traditional working parts found in all flashlights is a metallic spring. A spring which operates to separate the contact members that close the circuit when joined. The use of metallic parts, and particularly that which is highly conductible, such as made of copper, can be costly, and therefore, increases the cost of the flashlight beyond that of those that are normally disposable, and as a result, makes them commercially impractical for marketing as a budget item, on a mass basis.

Examples of existing flashlights can be seen in the U.S. Pat. No. 2,143,558, to Joers. This type of flashlight utilizes the usual spring combination. The patent to Prideaux, U.S. Pat. No. 2,367,888, also uses a spring for making its electrical contact. But, this flashlight is constructed having a tubular casing, that appears to be made out of some type of rubber, due to the cross-hatching of the material disclosed, and the push button, or switch, as disclosed, is apparently formed of some type of mercury switch, which operates off of gravity contact. The patent to Gelardin, U.S. Pat. No. 2,694,772, shows a flashlight with hermetically sealed casing, but once again it utilizes spring means to achieve its contact. The patent to D'Amore, et al, U.S. Pat. No. 3,105,233, identified as a fish caller, and which is apparently hermetically sealed, does depress a flexible diaphragm to make a battery contact, but it does not incorporate any type of O-ring configuration, whose resiliency maintains the flashlight normally in the "OFF" condition. The patent to Sussingham, U.S. Pat. No. 3,665,178, shows a reserve type flashlight, which does have a form of conductive wire, formed as a helical wire, that extends from the back end of the battery, up to the lamp, and which is placed into contact upon apparently depressing of its cap, against its button, in order to achieve electrical contact. But, it appears that this particular flashlight is one that once it is initiated, as by rupturing of its closure cap, it remains on and activated.

The patent to Ito, U.S. Pat. No. 4,109,405, shows a capsule lamp, but once again, it utilizes a spring means for attaining electrical contact for its lamp. And, this particular device is used as a form of illumination means for use in conjunction with fishing. The Sharrah U.S. Pat. No. 4,905,129, once again, shows a variety of spring means for attaining flashlight ignition through its tail cap switch. But, this device does disclose an imperforate flexible boot for enclosing the portion of the switching means for the shown flashlight. The disclosure shows an imperforate flexible boot for the flashlight, but as can be seen, its specification defines that it is one machined having an aluminum barrel. The patent to Roberts, U.S. Pat. No. 5,070,437, discloses an electrical light for underwater usage and application.

As shown in most of the prior art, they do incorporate metallic members, such as spring means, that do wear out and often loose their elasticity. As a result, resilient means have occasionally been used in place of springs as disclosed in the U.S. Pat. No. 3,105,233, as previously explained. A solid resilient means does not wear out as quickly as a spring, and therefore, adds utility and longevity to the usage and life of a flashlight when constructed in accordance with the teachings of this current invention.

SUMMARY OF THE INVENTION

The principal object of this invention is to provide a shaped resilient means for a flashlight electrical contact point that reduces wear, and functions as a primary ignition means for sustaining energization of a flashlight when compressed into an "ON" condition.

Another object of this invention is to provide a flashlight that is easy to assemble.

A further object is to provide a flashlight that is relatively inexpensive and permits replacement of its battery or batteries, even though the components of the flashlight in its assemblage appear to be more of a disposable type.

Still another object of this invention is to provide a flashlight made of polymer, compact of size, and can be easily carried in the pocket, or within the purse of its user.

Still another object of this invention is to utilize polymer parts for sustaining ignition, or turning off, of a manually operative flashlight.

Other objects will become more apparent to those skilled in the art upon reviewing this summary, and upon undertaking a study of the description of the preferred embodiment, in view of the drawing.

In accordance with this invention, generally stated, in a flashlight having a casing member that includes a light exposing end and a battery insertion end, is fabricated of polymer, and a sealing means to close the casing member is added at one end, with the light source projecting outwardly from the light exposing end, through an aperture provided within the casing, and with the light hermetically sealing against the edge of the casing aperture in order to add to the water tightness of this embodiment. The casing encloses a battery that powers the light source by communicating through a connector, the connector joins the light source to the battery, and includes a movable contact member for closing and opening the circuitry of the flashlight, for obtaining energization from its associated battery. The movable contact member is arranged proximal to the sealing means of the casing member. When pressure is applied to the sealing means, the movable contact member is urged towards the battery, this movement moves the movable contact member and compresses the resilient means which is arranged intermediately between the movable contact member and the battery. Continued compression of the resilient means provides for electrical contact between the movable contact member, and the battery, closing the circuitry for energization of the flashlight bulb.

DESCRIPTION OF THE PREFERRED EMBODIMENTS

Figure 1:
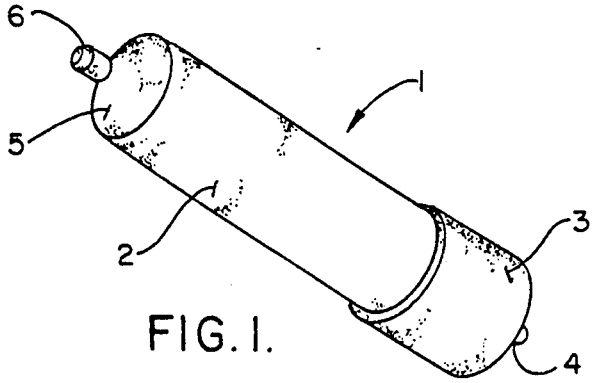
FIG. 1 is a perspective view of one embodiment of a resilient flashlight means of this invention.
Figure 2:
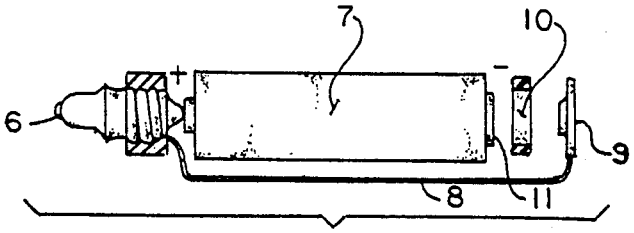
FIG. 2 is a partially exploded view of the operative internal components of the flashlight, with its casing member removed to provide clarity to its viewing.
Figure 2A:
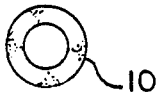
FIG. 2A is a plan view of the O-ring resilient means.
Figure 3:
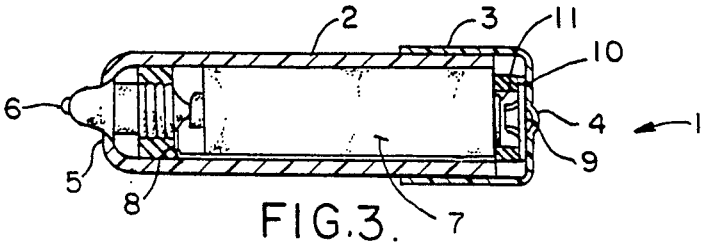
FIG. 3 is a longitudinal sectional view, in elevation, of the resilient flashlight means of this invention.
Figure 4:
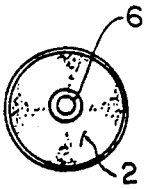
FIG. 4 is a front view in the light exposing end of the resilient flashlight means.
Figure 5:
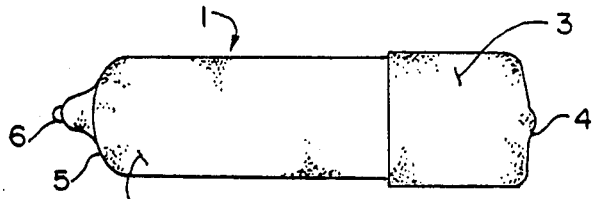
FIG. 5 is a side view thereof.
Figure 6:
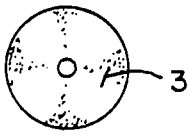
FIG. 6 is a back end view of the resilient flashlight means.

In referring to the drawings, and in particular FIG. 1, it shows a resilient flashlight means 1, of this invention, having a casing member 2, with a sealing means or end cap 3, to enclose the casing member 2, and its operating components. The resilient flashlight 1 has a battery insertion end 4, after the end cap is removed, and a light exposing end 5, having an aperture provided therethrough, and through which the light source 6, such as a bulb, projects its light therethrough, and outwardly from the exposing end of the flashlight. The bulb preferably tightly seals in conjunction with the edges of the aperture through which it inserts, in order to add to the watertightness of the flashlight. The casing member 2, which is formed of a polymer, conceals a battery 7, that powers the circuitry through its joining with a connector 8, which connector contacts with the conducting portion of the bulb 6, at one end, and secures with the contact member 9, at its other end. The connector 8 includes the movable contact member 9, which is arranged proximal to the sealing means 3, and is contiguous with the internal back end of said sealing means or end cap. The connector 8 provides for electrical charge to be transferred from the battery through the bulb, and back to the contact member, once the contact member is urged into electrical engagement against the back end of the battery 11. The movable contact member 9 is integrally flared to facilitate its contact with the back end of said battery, with the movable contact member 9 being separated from the battery 7, to maintain its non-contact, as when not in use, by means of a resilient means 10. One embodiment of the resilient means is an O-shaped ring, configured to normally provide sufficient space and separation between the back of the battery 11, and the contact member 9, as can be understood. On the other hand, because of the O-ring configuration of the resilient means 10, having an opening provided centrally therethrough, this shape allows the embodiment of the flared contact member 9 to be manually forced into movable contact against the back end of the battery 11, by extending its flared portion through the opening of the O-shaped means, as when manual pressure is applied. In particular, pressure from the battery insertion end 4, is urged against the contact member 9, that causes a depressing of the resilient means 10, allowing the flared end of the contact member 9 to make that electrical contact with the back end of the battery 11. As the compression decreases, the resilient means or O-ring 10 expands to its steady state condition, thereby forcing a separation between the contact member 9, and the back end 11 of the battery, to break contact and turn off the flashlight.

Figure 7:
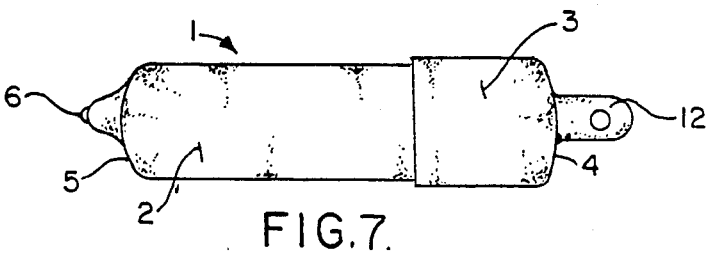
FIG. 7 is a side view of a further embodiment of the resilient flashlight means of this invention.
Figure 8:
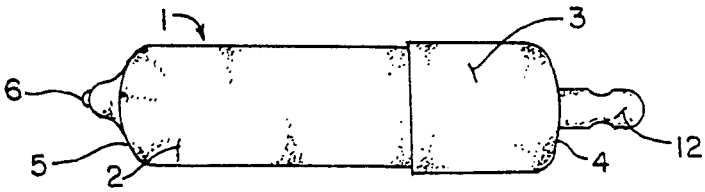
FIG. 8 is a top view of the resilient flashlight means as disclosed in FIG. 7; and, FIG. 9 is a partially exploded view, partially provided in section, of the operative internal components of a modified flashlight, with its casing member being removed to provide clarity to its viewing.

As can be seen in FIGS. 7 and 8, the back end or sealing means 3 of the flashlight may have integrally formed therewith a rearwardly extending stem 12, and which has the shown aperture provided through it, for reception of key ring, lanyard, cord, or any other type of means that may facilitate the usage and retention of this flashlight, by its user.

Figure 9:
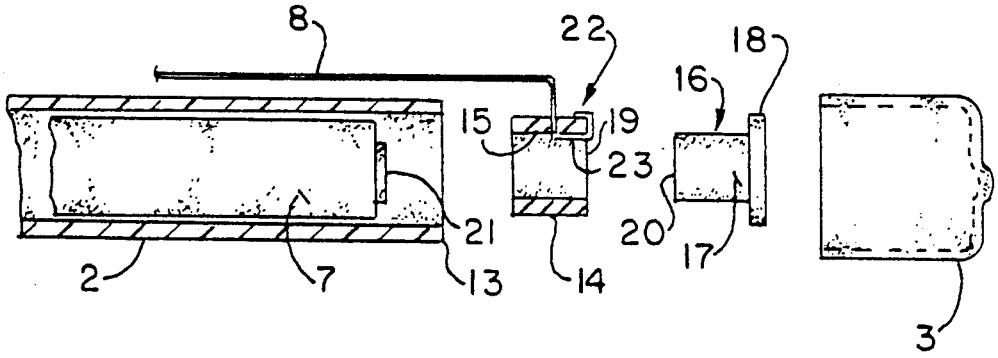

As can be seen in FIG. 9, a modified form of flashlight, embodying the principles of this invention, is disclosed. As can be seen, the casing member 2 yet surrounds the battery 7, and the back end, as at 13, will be sealed off and closed by means of the application of the sealing means 3, constructed similarly to that as previously defined. But, the operative components that provide for illumination of the flashlight, and conduct charge to its bulb, have been slightly revised. As can be seen, instead of utilizing the O-shaped ring 10, in this embodiment, a slightly elongated sleeve 14 is employed. The sleeve is constructed of a resilient material, preferably a polymer, or maybe formed of rubber, but in the preferred embodiment, is formed as a silicone sleeve. The sleeve has reasonable length, and has a channel 15 provided therethrough. Disposed for inserting, partially, into the channel 15 of the sleeve, is a contact member 16, which in this particular instance is configured as a length of rivet, having a shaft portion 17 of slightly lesser diameter than the channel 15, so as to snugly fit therein, and integrally having a head forming the flange 18 provided thereon. The member 16 is formed of an electrically conducting material such as brass, copper, or related material. The shaft 17 fits within the channel 15, until such time as the flange 8 comes into contact against the contiguous end 19, of the silicone sleeve. The length of the shaft 17 is slightly less than the length of the sleeve 14, so that the resilient silicone sleeve normally maintains the contact face 20 of the contact member 16 out of engagement with the backend 21 of the battery, but that due to the unique resiliency of the silicone sleeve, which is formed of a weaker polymer material, slight pressure exerted upon the back of the sealing means 3 forces the contact member 16 to cause a collapse of the sleeve 14, allowing the face 20 of the member 16 to engage against the back of the battery 21, and to illuminate the light. Release of a finger from against the sealing means 3 allows the sleever 14 to force the contact member 16 out of engagement with the back of the battery, and thereby shut off the flashlight.

Another advantage of constructing the various components for the flashlight in this manner is that the electrical connector 8 that extends rearwardly intermediate the casing member 2 and the side of the battery 7 extends back towards the sleeve 14, and rather than requiring the back end 22 of the connector or wire 8 to be soldered into contact with the movable contact member 16, the wire can be impaled through the side wall of the sleeve 14, and then again inserted outwardly through the sleeve wall, as can be seen, and then bent back to achieve its fixing at that location with respect to the sleeve. But, since an inner surface 23 of the wire is located interiorly of the sleeve 14, and within its channel 15, when the contact member 16 is inserted within the sleeve, during assembly, the shaft 17 of the sleeve will always be in contact with the wire segment 23, to assure permanent engagement, and electrical contact, thereby alleviating the need to require any further, costly, and time consuming welding or soldering of the wire 8 to the movable contact member 16.

The foregoing are examples as to how the flashlight is capable of revision, so as to provide and form and readily assembled flashlight, reasonably hermetically sealed, easily manipulable and usable, because of its inherent resiliency, small enough and compact to be easily stored within a pocket or purse, provide ample light when used, and yet, provide significant surface area, particularly along the outer surface of the casing member 2, and to which various types of indicia, such as advertising, may be applied for use of this particular item as a promotional means.

Variations or modifications to the subject matter of this invention may occur to those skilled in the art upon reviewing the subject matter herein. Such variations, if within the spirit of this invention, are intended to be encompassed within the scope of any claims to patent protection issuing upon this invention. The description of the preferred embodiment provided herein is done so for illustrative purposes only.

Having thus described the invention, what is claimed and desired to be secured by Letters Patent is:

1. A flashlight comprising a casing member having a light exposing end and a battery insertion end, a sealing means to close said casing member, a light source for projecting light outwardly from said light exposing end of said casing member, a battery enclosed by said casing member, said battery for energizing said light source, a conductor joining said light source to said battery, said conductor includes a movable contact member for closing and opening a circuit of said flashlight, said movable contact member proximal to said sealing means, the improvement comprising a resilient means arranged between said movable contact member and said battery, wherein pressing said movable contact member towards said battery compresses aid resilient means connecting said movable contact member to said battery and closing said circuit, said sealing means further comprising a resilient material, said resilient material being a polymer, said battery operated components including said movable contact member, said resilient means, said battery, and said light source, all of said movable contact member, resilient means, battery, and said light source all being axially aligned within said casing member, whereby closing said circuit illuminates said light source, said movable contact member includes a raised portion positioned proximal to said battery, said raised portion being integrally flared, said integral flaring portion facilitates contacting of said movable contact member to said battery, wherein applying pressure on the back of said sealing means and movable contact member pushes the integral flared portion of said movable contact member into proximity with said battery by compressing said resilient means, said resilient means comprising a resilient sleeve, said flared portion of said movable contact member forming a shaft means located within said sleeve, and wherein pressing said movable contact member towards said battery compresses said resilient sleeve connecting said movable contact member to said battery and closing said circuit, said movable contact member further including a flange, integrally formed of its shaft means, wherein the insertion of the shaft means of the movable contact member within the resilient sleeve, the flange of the shaft means abuts against an end of the sleeve, and said conductor extending through said sleeve and electrically contacting said movable contact member to maintain electrical contact between the movable contact member and the light source when said movable contact member is compressed into engagement with said battery.

2. The flashlight of claim 1 wherein said casing member comprises a rigid plastic.

3. The flashlight of claim 2 wherein said plastic is a polymer.

4. The flashlight of claim 2 wherein said casing member includes a surface to accommodate print material.

5. The flashlight of claim 1 wherein said sealing means is removable.

6. The flashlight of claim 1 wherein said resilient sealing means may be pressured against the battery operating components closing the circuit.

7. The flashlight of claim 1 wherein said sealing means is sized to hermetically close said casing.

8. The flashlight of claim 1 wherein said light source is removable and replaceable.

9. The flashlight of claim 8 and wherein said casing member having an aperture through which the light source projects, said light source comprising a light that seals within the aperture of the casing means during installation.

10. The flashlight of claim 1 wherein said battery is removable and replaceable.

11. The flashlight of claim 1 wherein said resilient means further comprises a soft material.

12. The flashlight of claim 11 wherein said soft material further comprises silicone.

13. The invention of claim 1 wherein said sleeve being formed of a resilient material.

14. The invention of claim 13 wherein said resilient material is silicone.

* * * * *

UNITED STATES PATENT AND TRADEMARK OFFICE

CERTIFICATE OF CORRECTION

PATENT NO. : 5,317,490

DATED : May 31, 1994

INVENTOR(S) : Joseph T. Miller

It is certified that error appears in the above-identified patent and that said Letters Patent is hereby corrected as shown below:

Column 5:

Claim 1, line 53, change "aid" to ---said---.

Signed and Sealed this

Thirtieth Day of August, 1994

*Attest:*

*Attesting Officer*

Bruce Lehman

BRUCE LEHMAN

*Commissioner of Patents and Trademarks*